United States Patent [19]

LeVine et al.

[11] Patent Number: 4,469,390

[45] Date of Patent: Sep. 4, 1984

[54] CRIMPED CONNECTOR

[75] Inventors: Donald J. LeVine, Tarrytown; Victor L. Salvador, Mamaroneck, both of N.Y.

[73] Assignee: Kings Electronics Co., Inc., New York, N.Y.

[21] Appl. No.: 386,633

[22] Filed: Jun. 9, 1982

[51] Int. Cl.[3] ..... H01R 11/08

[52] U.S. Cl. ..... 339/95 R; 339/177 R; 339/276 T

[58] Field of Search ..... 339/95 R, 97 C, 117 R, 339/276 R, 276 T

[56] References Cited

U.S. PATENT DOCUMENTS

| | | | |
|---|---|---|---|
| 3,510,829 | 5/1970 | Keller | 339/177 R |
| 4,178,054 | 12/1979 | Laudig | 339/177 R |
| 4,400,050 | 8/1983 | Hayward | 339/177 R |

FOREIGN PATENT DOCUMENTS

| | | | |
|---|---|---|---|
| 2255831 | 7/1975 | France | 339/177 R |
| 458749 | 12/1936 | United Kingdom | 339/95 R |
| 579365 | 8/1946 | United Kingdom | 339/177 R |

*Primary Examiner*—Joseph H. McGlynn

*Attorney, Agent, or Firm*—Jordan B. Bierman; Linda Bierman

[57] ABSTRACT

The invention is directed to an arrangement for simply and inexpensively attaching semirigid coaxial cable to suitable connectors in which the connector is provided with a sleeve having either internal fluting or cross threads. The effective internal diameter of the sleeve is only slightly greater than the external diameter of the outer conductor of the semirigid cable so that when the sleeve is crimped the flutes and/or threads bite into the outer conductor to form a connector-cable bond sufficiently resistant to pull-off, twisting and slipping, while at the same time forming a joint having an acceptably low radio signal power leakage through the crimped interface and so little dimensioning effect on the cable that transmission losses due to internal reflections are maintained acceptably low.

3 Claims, 7 Drawing Figures

CRIMPED CONNECTOR

The invention is directed to an improved arrangement for attaching a semirigid coaxial cable to a connector.

In the coaxial cable art involving the transmission of high frequency signals, at least two problems arise when two cables are to be interconnected or when a cable is to be connected to a terminal device. The first is the mechanical strength of the connectors and the second concerns the electrical effects of the interconnection such as maintaining an acceptably low radio signal power leakage through the cable-connector interface and minimum transmission losses due to internal reflections. These problems have reasonably been solved by direct soldering of the outer cable conductor to the connector or by a clamp and collet type of attachment means. Another arrangement is to knurl the outer surface of a semirigid outer conductor to make an interference force fit to the connector body.

It is an object of the present invention, in the case of a coaxial cable having a semirigid outer conductor, to provide a simple and improved interconnection between the coaxial conductor and connector which avoids the mechanical parts and/or mechanical steps heretofore deemed necessary while still meeting satisfactory mechanical and electrical criteria.

A further object of this invention is to provide means establishing a mechanically strong and electrically satisfactory connection between a semirigid coaxial cable and connector therefor, which does not involve the step of soldering the cable to the connector, which avoids the clamp and collet type of attachment, and which does not require the scoring or knurling of the outer surface of the outer cable conductor to provide an interference force fit with a connector body.

More specifically it is an object of this invention to provide a simple crimp connection between a connector body and the outer conductor of a coaxial cable which is sufficiently resistant to pull-off, twisting and slipping and at the same time has acceptably low power leakage and transmission losses.

The aforesaid objects are attained by providing the body to which the coaxial cable is to be attached with a sleeve having inwardly directed projections in the form of flutes and/or threads which, upon crimping of the sleeve, will bite into the outer surface of the outer conductor of the coaxial cable to provide a mechanical connection of sufficient strength while effecting an electrical connection having suitably minimum losses.

The above objects and advantages of the present invention will be more clearly demonstrated by the detailed description thereof which follows, and as more particularly illustrated in the accompanying drawings in which.

FIGS. 1–4 illustrate the application of one form of the present invention to the attachment of a semirigid coaxial cable to a conventional connector body. A typical female connector is illustrated having a threaded outer shell 2, and internal supporting insulator 4 and a central flexible connector 6. The threaded shell 3 and connector 6 are adapted to be mechanically and electrically connected to a typical male connector (not shown).

Figure 2:
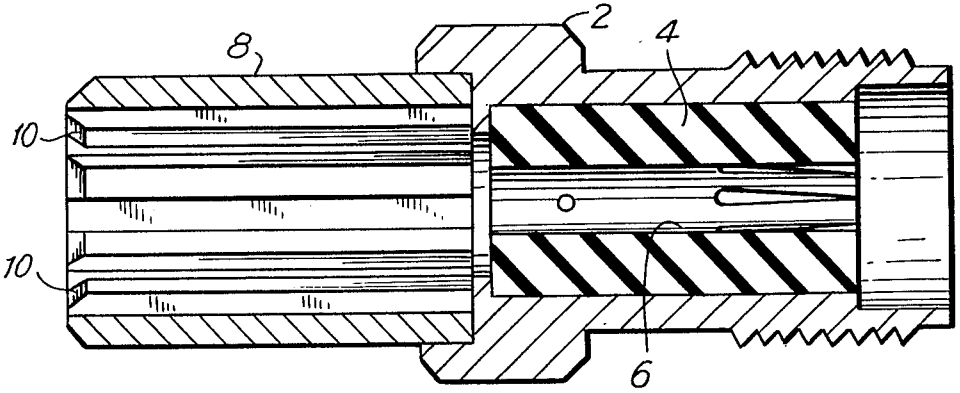
FIG. 2 is a longitudinal cross-sectional view of the connector taken along the line 2—2 of FIG. 1.
Figure 1:
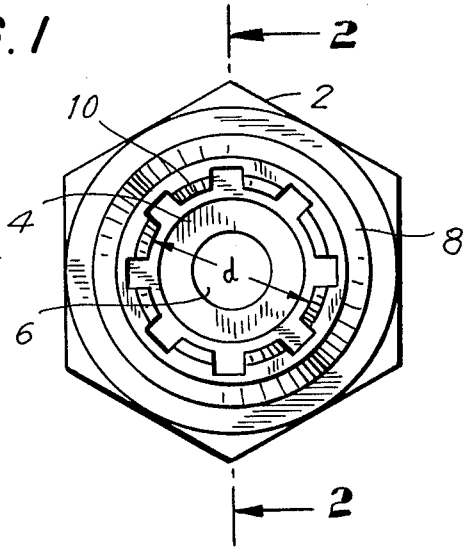
FIG. 1 is an end view of a connector having a crimpable fluted sleeve in accordance with one form of our invention.

Extending longitudinally outwardly from the connector body 2 supported by and attached thereto as by soldering or other suitable means is a sleeve 8 having a plurality of radially spaced, inwardly projecting integral flutes 10. FIGS. 1 and 2 show the construction of a connector according to this invention prior to the insertion of and/or connection to a semirigid coaxial cable. The internal diameter "d" between flute ends is slightly greater than the external diameter of the coaxial cable to which connection is to be made. In other words, the cable can slip in easily with the center conductor to be attached to central conductor 6 in a manner well known in the art.

Figure 4:
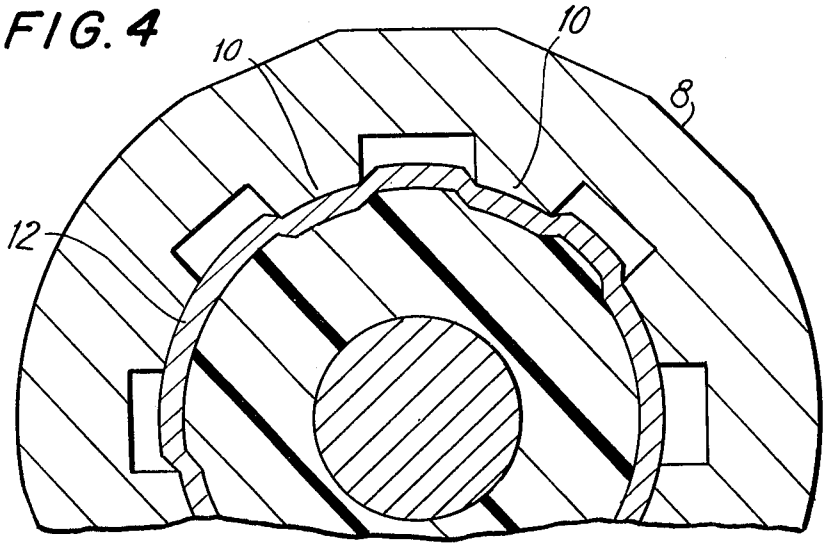
FIG. 4 is an enlarged transverse cross-sectional view taken along the line 4—4 of FIG. 3.
Figure 3:
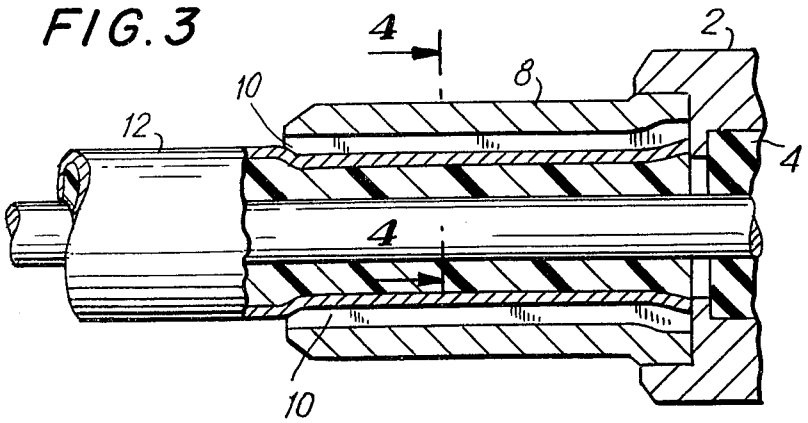
FIG. 3 is a longitudinal cross-sectional view similar to FIG. 2 showing the connector embracing a semirigid coaxial cable.

FIGS. 3 and 4 show a semirigid coaxial cable 12 crimped within the sleeve 8 of connector 2. While not necessary to the effectiveness of the invention, a simple known hexagonal die may be used in the crimping operation with the result that not all of the flutes may bite into the outer conductor, as is more clearly shown in FIG. 4.

Utilizing a crimp connector as illustrated in FIGS. 1–4, tests showed an RF leakage of less than 90 decibels while the cable illustrated withstood pull tests from 60 to 130 lbs.

While sleeve 8 to be crimped about the coaxial cable 12 is shown as soldered or otherwise attached to connector body 2, it may be formed unitarily therewith with the sleeve section zone annealed to permit deformation.

Figure 6:
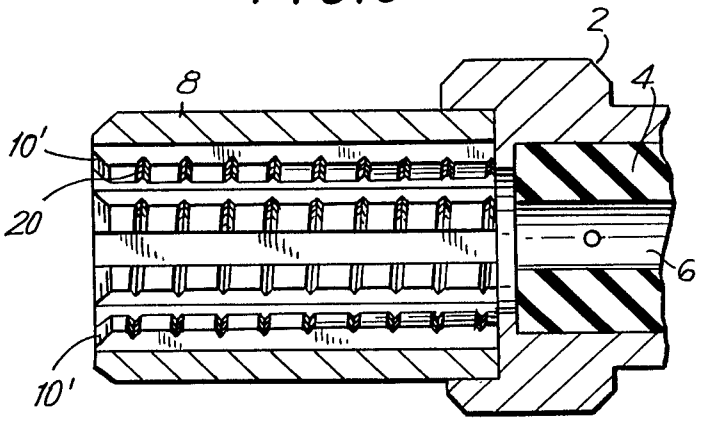
FIG. 6 is a longitudinal cross-sectional view taken along the line 6—6 of FIG. 5.
Figure 5:
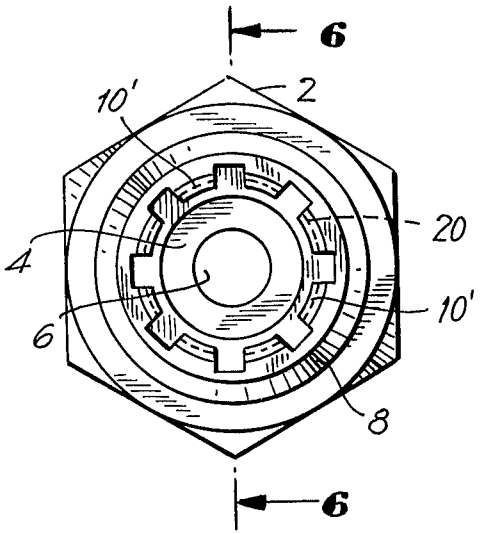
FIG. 5 is an end view similar to FIG. 1 illustrating a modified form of the invention.

A variation of the arrangement shown in FIGS. 1–4 is illustrated in FIGS. 5 and 6, the sole difference being that flutes here designated as 10' are threaded or transversely scored as indicated at 20. This provides an additional biting surface and in fact can triple the pull resistance without adversely affecting the RF leakage.

Figure 7:
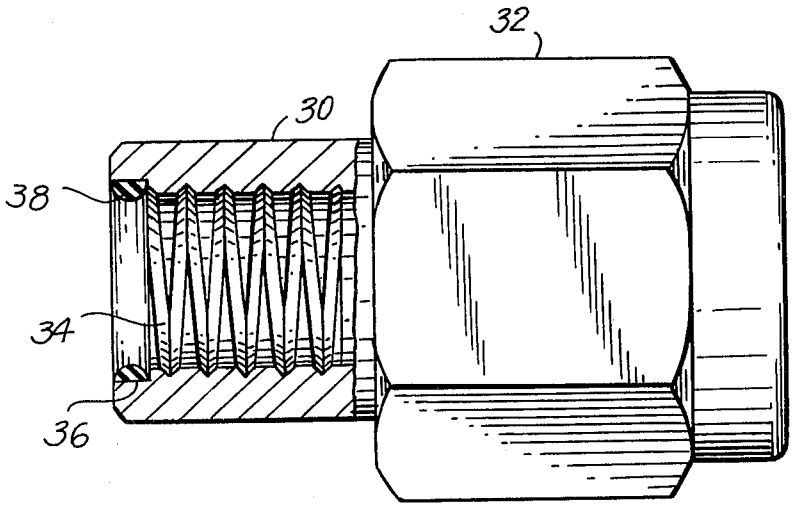
FIG. 7 is a longitudinal view in partial cross-section showing a still further modified form of invention as applied to another connector body.

Still another version of our invention is illustrated in FIG. 7 in which sleeve 30 attached to a connector body 32 is provided with internal cross-threads 34 (right and left hand threads), longitudinal fluting in this case being eliminated. This form of invention provides resistance to pull comparable to the threaded fluting previously described and there is no loss in the RF leakage characteristics. We have also shown in FIG. 7 the use of a weatherproof gasket to prevent water leakage between cable and sleeve. The outer end of sleeve 30 is provided with a recessed annulus 36 in which is placed an annular gasket 38, preferably of soft rubber or sealing compound, which will be pressed against the outer conductor of the cable (not shown).

The invention above described meets all the criteria and objects previously stated. The invention is applicable to all sizes of semirigid coaxial cable. Cable preparation is simple and it is trimmed according to standard procedures. The sleeve or crimp body is preferably round. Compression of the sleeve to a depth of between 0.006" to 0.010" is sufficient to provide adequate mechanical strength without severely deforming the center dielectric of the cable.

The invention is not intended to be limited to the specific examples described and illustrated, but only as required by the claims which follow.

What we claim is:

1. In an electrical connector of the type adapted to receive a coaxial cable having an inner conductor surrounded by a dielectric and in turn by a semirigid outer conductor, wherein center connecting means are mechanically and electrically attached to the inner conductor and coupling means are electrically and mechanically attached to the outer conductor, the improvement comprising a radially deformable sleeve forming part of said coupling means and surrounding the semirigid outer conductor of the cable to be attached, and means forming projections within said sleeve whose inner ends are threaded and which extend radially inwardly to immediately surround the semirigid outer conductor, whereby upon crimping of said deformable sleeve said projections bite into the outer surface of said semirigid outer conductor and attach the same to the coupling means of said connector against rotational or longitudinal movement.

2. In an electrical connector according to claim 1, in which said integral projections are circumferentially spaced one from the other about the inner periphery of said sleeve and extend longitudinally as flutes within said sleeve where the sleeve contacts the semirigid outer conductor.

3. An electrical connector according to claim 1 in which the outer end of said sleeve is formed with an internal annulus having a diameter greater than the external diameter of the said outer conductor, in combination with an annular seal placed in said annulus about said outer conductor.

* * * * *